US008387838B2

(12) United States Patent
Adams et al.

(10) Patent No.: US 8,387,838 B2
(45) Date of Patent: Mar. 5, 2013

(54) DEVICE FOR USE IN FOLDING FITTED SHEETS

(76) Inventors: Janet F. Adams, Melbourne, FL (US); William R. S. Adams, Melbourne, FL (US)

( * ) Notice: Subject to any disclaimer, the term of this patent is extended or adjusted under 35 U.S.C. 154(b) by 299 days.

(21) Appl. No.: 12/798,987

(22) Filed: Apr. 15, 2010

(65) Prior Publication Data

US 2011/0253755 A1 Oct. 20, 2011

(51) Int. Cl.
*A41H 33/00* (2006.01)

(52) U.S. Cl. ..... 223/37

(58) Field of Classification Search ..... 223/37, 223/1; 493/405, 406; 53/117
See application file for complete search history.

(56) References Cited

U.S. PATENT DOCUMENTS

| | | | | |
|---|---|---|---|---|
| 2,905,367 | A * | 9/1959 | Coutu | 223/37 |
| 3,236,425 | A * | 2/1966 | Sipe | 223/37 |
| 3,510,031 | A * | 5/1970 | Robinson | 223/37 |
| 3,538,555 | A * | 11/1970 | Langston | 24/332 |
| 3,689,059 | A * | 9/1972 | Gross | 269/100 |
| 3,713,643 | A | 1/1973 | Gerstenberger | |
| 3,884,459 | A | 5/1975 | Gunn et al. | |
| 3,984,036 | A * | 10/1976 | Fritschi | 223/37 |
| 3,994,485 | A * | 11/1976 | Weir | 493/408 |
| 4,018,368 | A | 4/1977 | Haldi | |
| 5,816,434 | A * | 10/1998 | Weinstein | 223/37 |

FOREIGN PATENT DOCUMENTS

CN 201847417 U * 6/2011

* cited by examiner

*Primary Examiner* — Shelley Self
*Assistant Examiner* — Andrew Sutton
(74) *Attorney, Agent, or Firm* — William E. Hein

(57) ABSTRACT

A fitted bedsheet folding aid includes a telescoping left rod assembly having a pair of door hangers attached thereto for supporting the fitted bedsheet folding aid over the top of a door. A telescoping right rod assembly longitudinally abuts the left rod assembly and is attached thereto by means of a hinge to permit the right rod assembly to be rotated clockwise 180 degrees away from the door from an open position in which it is longitudinally aligned with the left rod assembly to a closed position in front of the left rod assembly. The length of each of the telescoping rod assemblies is adjustable to accommodate king, queen, double or twin fitted sheets. A spring-loaded tip member at each end of the telescoping rod assemblies is urged outwardly to maintain taut a sheet spanning the telescoping rod assemblies.

6 Claims, 4 Drawing Sheets

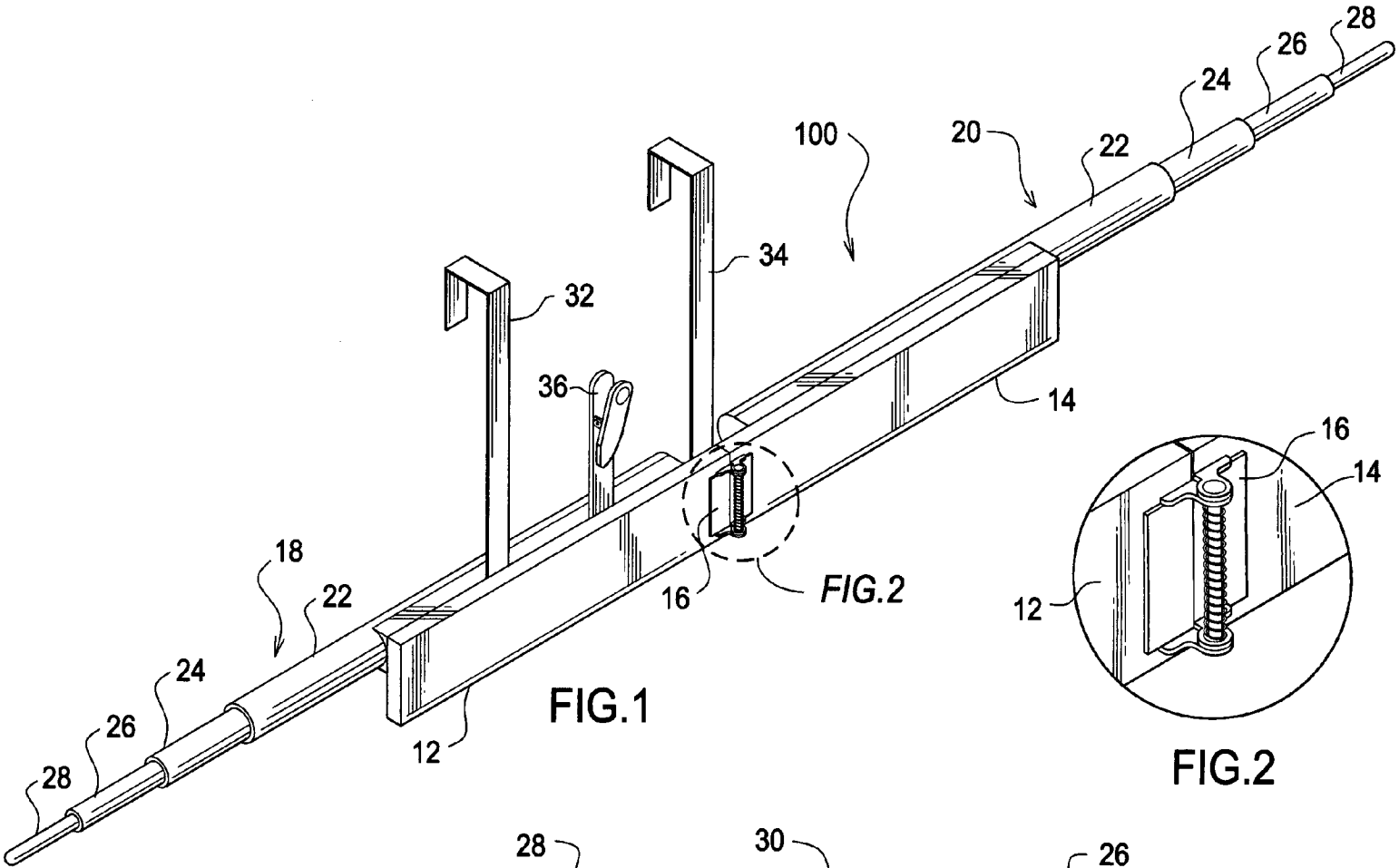
FIG.1
FIG.2
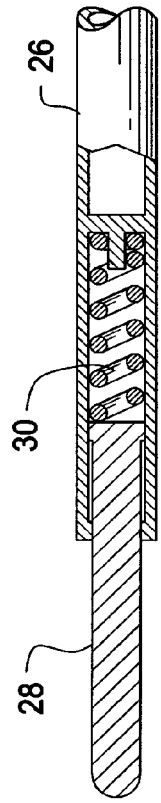
FIG.3

DEVICE FOR USE IN FOLDING FITTED SHEETS

BACKGROUND AND SUMMARY OF THE INVENTION

This invention relates generally to fitted or contour bedsheets and, more particularly, to a device that aids in folding those types of bedsheets.

Nearly all users of fitted bedsheets experience difficulty while attempting to neatly fold them. Rectangular flat sheets can be quickly and easily folded by simply bringing adjacent pairs of the four square corners thereof together as many times as necessary to fold them into neat packages of uniform thickness having a desired final size. A fitted sheet, however, includes a base portion which covers the top surface of a mattress and a skirt attached to the periphery of the base portion of the sheet. The skirt includes corner pockets that fit over the corners of the mattress to hold the fitted sheet in place. The corner pockets are painstakingly difficult to align in order to neatly fold the sheet. A fitted sheet that is folded like a flat sheet with the ends and sides of the skirt first folded over the base portion results in a folded package having bulges resulting from the overlapping of the skirt with the base portion of the sheet. These bulges occur particularly at the corners of the folded package. As a result, it is more difficult to store fitted or contour sheets because, when so folded, they do not result in a package of uniform thickness. Two persons are typically required to quickly and satisfactorily fold a fitted sheet. Consequently, many women hesitate to purchase and use fitted sheets, even though they are very presentable on a bed and serve their intended function of remaining in a secure position over the mattress.

Various devices and methods for enabling one person to fold both flat and fitted bedsheets and blankets are known in the prior art. For example, U.S. Pat. No. 2,905,367 to Coutu describes a device for folding a freshly-ironed sheet that eliminates the need for a second person. U.S. Pat. No. 3,236,425 to Sipe describes a device and method for aiding in folding contour sheets. U.S. Pat. No. 3,510,031 to Robinson describes an apparatus employing a foot pedal for use in folding sheets and other laundry flatwork. U.S. Pat. No. 3,538,555 to Langston describes a spring-tensioned device for vertically stretching one edge of a sheet to be folded. U.S. Pat. No. 3,689,059 to Gross describes a foot-operated laundry folding accessory. U.S. Pat. No. 3,713,643 to Gerstenberger describes a foot-actuated electrical device for holding one edge of a bedsheet in a taut vertical position. U.S. Pat. No. 3,884,459 to Gunn et al. describes a complex foot-operated electromechanical apparatus for assisting a person while folding a bedsheet. U.S. Pat. No. 3,984,036 to Fritschi describes an apparatus for aiding in folding and pleating sheets and blankets. U.S. Pat. No. 3,994,485 describes a foot-operated electromechanical floor console for use in folding laundry sheets. U.S. Pat. No. 4,018,368 to Haldi describes a foot-operated device that holds one edge of a bedsheet in a taut vertical position to facilitate manual folding thereof. U.S. Pat. No. 5,816,434 to Weinsein describes a sheet folding aid that employs an outwardly protruding folding bar mounted in a fixed position to a vertical base.

In accordance with the illustrated preferred embodiment of the present invention, a fitted bedsheet folding aid includes a telescoping left rod assembly having a pair of door hangers attached thereto for supporting the fitted bedsheet folding aid over the top of a door. A telescoping right rod assembly longitudinally abuts the left rod assembly and is attached thereto by means of a hinge to permit the right rod assembly to be rotated clockwise 180 degrees away from the door from an open position in which it is longitudinally aligned with the left rod assembly to a closed position in front of the left rod assembly. The length of each of the telescoping rod assemblies is adjustable to accommodate king, queen, double or twin fitted sheets. A spring-loaded tip member at each end of the telescoping rod assemblies is urged outwardly to maintain taut a sheet spanning the telescoping rod assemblies. A spring clip mounted on the left rod assembly proximate the hinge provides a point of attachment of the top edges of the sheet spanning the telescoping rod assemblies midway along the span.

BRIEF DESCRIPTION OF THE DRAWINGS

FIG. 1 is a front perspective view of the fitted bedsheet folding aid of the present invention in its open position.

FIG. 2 is a detailed diagram of the hinge that serves to connect the left and right rod assemblies of the fitted bedsheet folding aid of FIG. 1.

FIG. 3 is a cross-sectional view of one of the spring-loaded tips at the end of each of the left and right rod assemblies of the fitted bedsheet folding aid of FIG. 1.

DESCRIPTION OF THE PREFERRED EMBODIMENT

Figure 4:
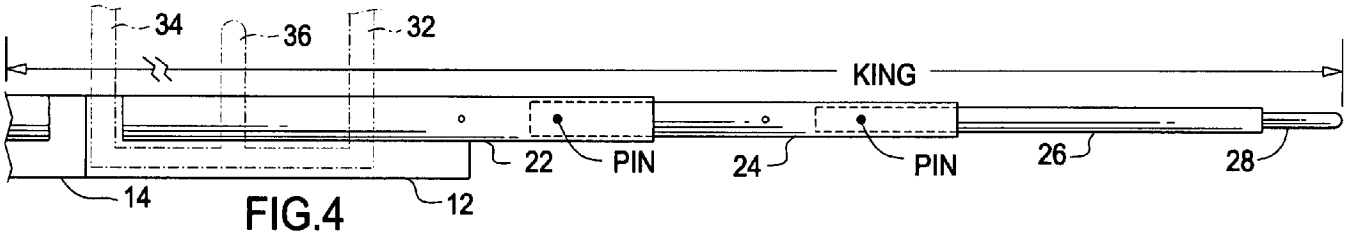
FIGS. 4-7 are rear elevation views of the left rod assembly of the fitted bedsheet folding aid of FIG. 1, illustrating the way in which the length of each of the left and right rod assemblies may be adjusted to accommodate king, queen, double, and twin size bedsheets, respectively.
Figure 5:
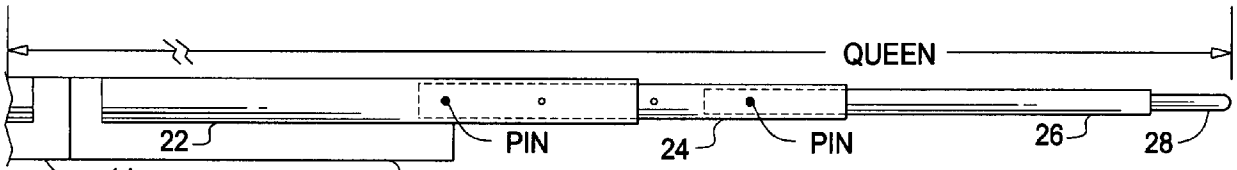
Figure 6:
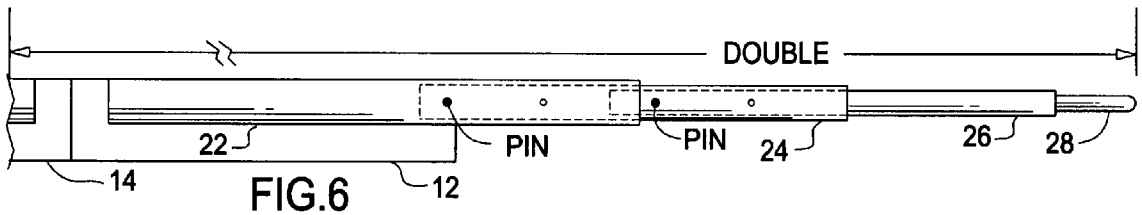
Figure 7:
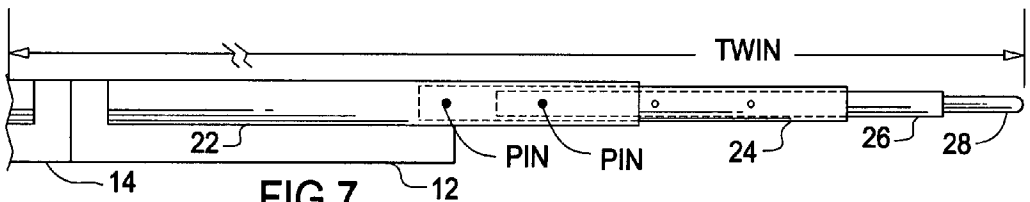

Referring now generally to FIGS. 1-7, there is shown a fitted bedsheet folding aid 100 in accordance with the present invention. Fitted bedsheet folding aid 100 includes left and right rod assembly supports 12, 14, respectively, that are positioned end-to-end and connected at the abutting ends thereof by means of a hinge 16 mounted on a front face of each of the rod assembly supports 12, 14 so as to permit right rod assembly support 14 to be rotated clockwise from its initial or open position illustrated in FIG. 1 in which it is longitudinally aligned with left rod assembly support 12 to its folded or closed position in front of left rod assembly support 12, as shown in FIG. 10.

Telescoping rod assemblies 18, 20 are fixedly attached to the rear surfaces of rod assembly supports 12, 14, respectively. Each of the rod assemblies 18, 20 includes a rod section 22 of larger diameter that is mounted to the rear surface of each of the rod assembly supports 12, 14 and rod sections 24, 26, 28 of successively smaller diameter that are arranged in telescoping relationship to each other for the purpose of facilitating adjustment of the overall length of rod assemblies 18, 20 so that fitted bedsheets commonly sized as king, queen, double, or twin may all be accommodated. The length of the exposed portions of rod sections 24, 26 may be adjusted, as illustrated in FIGS. 4-7, in accordance with the aforementioned common sizes of bedsheets. Adjustment of the telescoping rod sections 24, 26 may be readily accomplished by employing any of a number of conventional techniques for doing so, such as the pin and hole arrangement illustrated in FIGS. 4-7. Unlike telescoping rod sections 24, 26 whose exposed length is adjustably fixed, rod tip section 28 of each of the rod assemblies 18, 20 is arranged for a predetermined range of telescoping movement within rod section 26 against a compression spring 30, which urges each of the rod tip sections 28 outwardly.

Figure 8:
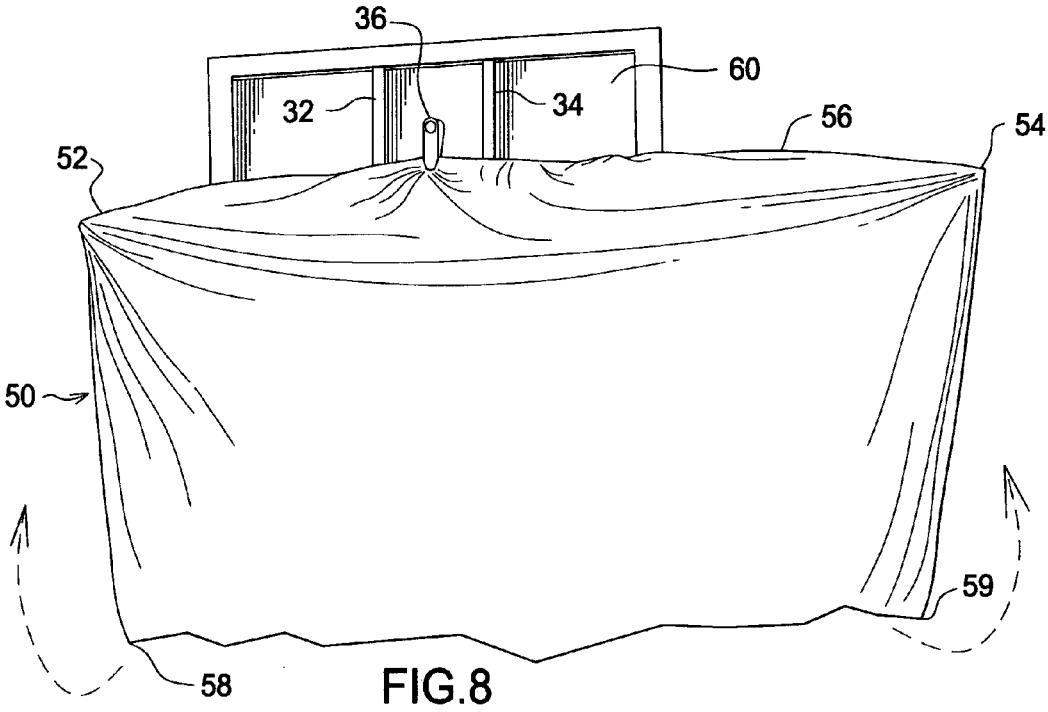
FIG. 8 is a pictorial diagram illustrating the fitted bedsheet folding aid of FIG. 1 in use, mounted on a door, one of the shorter edges of a fitted bedsheet to be folded being suspended on and spanning the left and right rod assemblies of the fitted bedsheet folding aid, the upper two corner pockets of the suspended bedsheet being hooked over the spring-loaded tips of the rod assemblies, the edge of the bedsheet spanning the rod assemblies being clipped thereto at a point midway between the spring-loaded tips thereof, the arcuate dotted lines illustrating how the bottom shorter edge of the fitted bedsheet is then lifted by the user.
Figure 9:
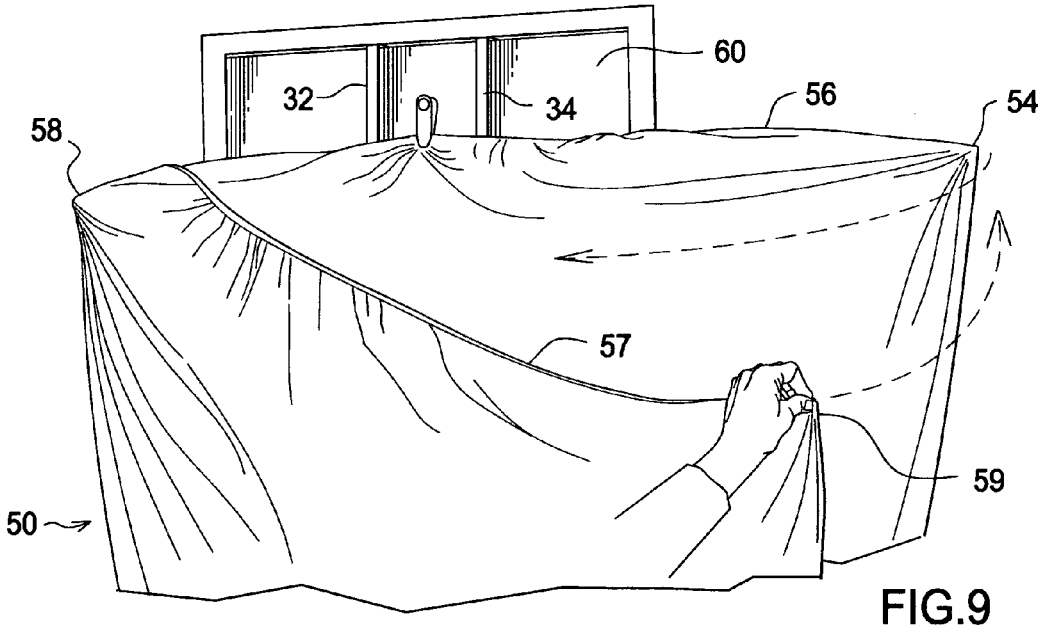
FIG. 9 is a pictorial diagram illustrating the sequence of steps performed by the user following positioning of the fitted bedsheet as shown in FIG. 8, the lower left corner pocket of the fitted bedsheet first being lifted and positioned over the upper left corner pocket of the fitted bedsheet that was previously hooked over the spring-loaded tip of the left rod assembly, the lower right corner pocket of the fitted bedsheet then being lifted by the user and positioned over the upper right corner pocket of the fitted bedsheet that was previously hooked over the spring-loaded tip of the right rod assembly, the arcuate dotted line illustrating the path of the right rod assembly as the user swings it outward away from the door into the position in front of the left rod assembly, as illustrated in FIG. 10.
Figure 10:
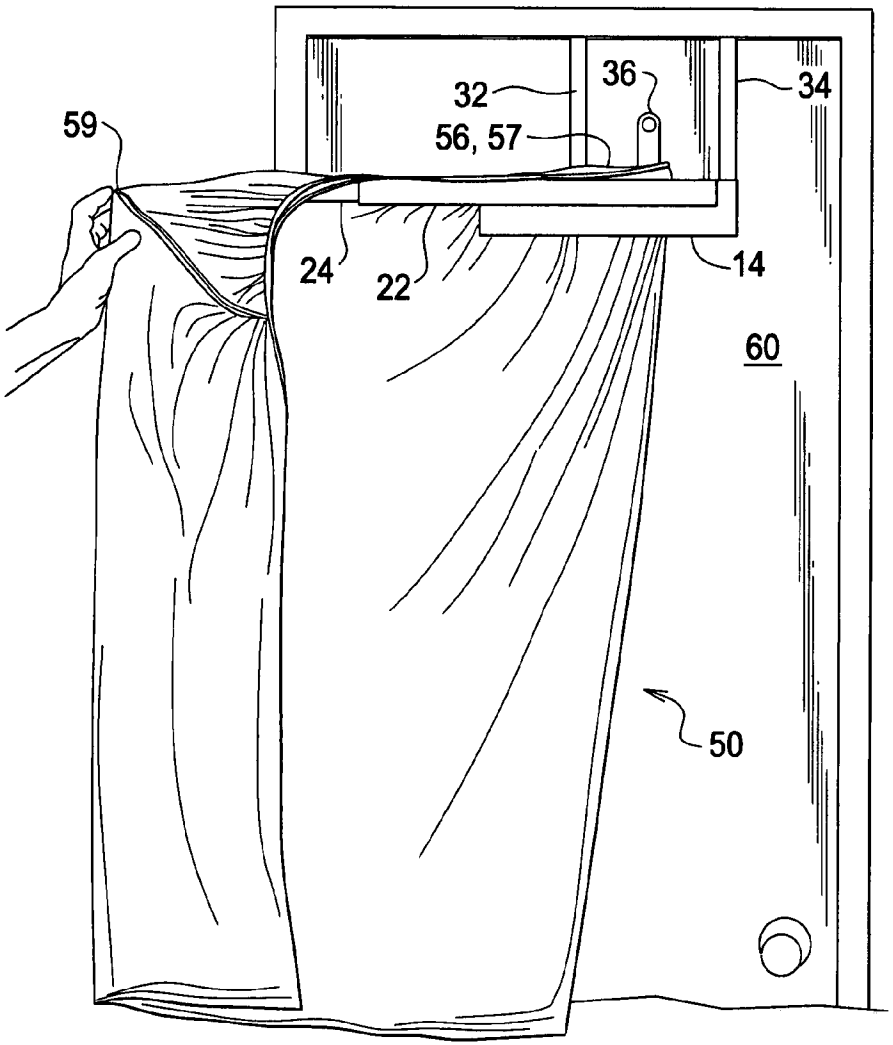
FIG. 10 is a pictorial diagram of the fitted bedsheet folding aid of FIGS. 1 and 8-10 and the fitted bedsheet attached thereto, in its folded or closed position that allows the user to remove the fitted bedsheet for further manual folding steps.

Referring additionally to FIGS. 8-10, fitted bedsheet folding aid 100 may be attached to a door 60 by means of a pair of upwardly extending hangers 32, 34 that are secured to the rear surface of left rod assembly support 12 and adapted to fit over the top of door 60, which may be a residential laundry room door, for example. Alternatively, hangers 32, 34 may be eliminated, and rod assembly support 12 of fitted bedsheet folding aid 100 may be mounted at a user's desired height to some other vertical surface by means of any conventional mounting arrangement. A sheet clip 36 is attached at a position along rod assembly support 12 that is near the inner end thereof at which hinge 16 is attached. It will be appreciated that right rod assembly 20 of fitted bedsheet folding aid 100 is arranged to be moveable with respect to fixed left rod assembly 18 in consideration of a right-handed user. In order to accommodate the natural tendencies of a left-handed user, fitted bedsheet folding aid 100 may be constructed such that right rod assembly 20 is fixedly mounted to door 60 or some other vertical surface, with left rod assembly 18 being moveable with respect thereto.

Figure 11:
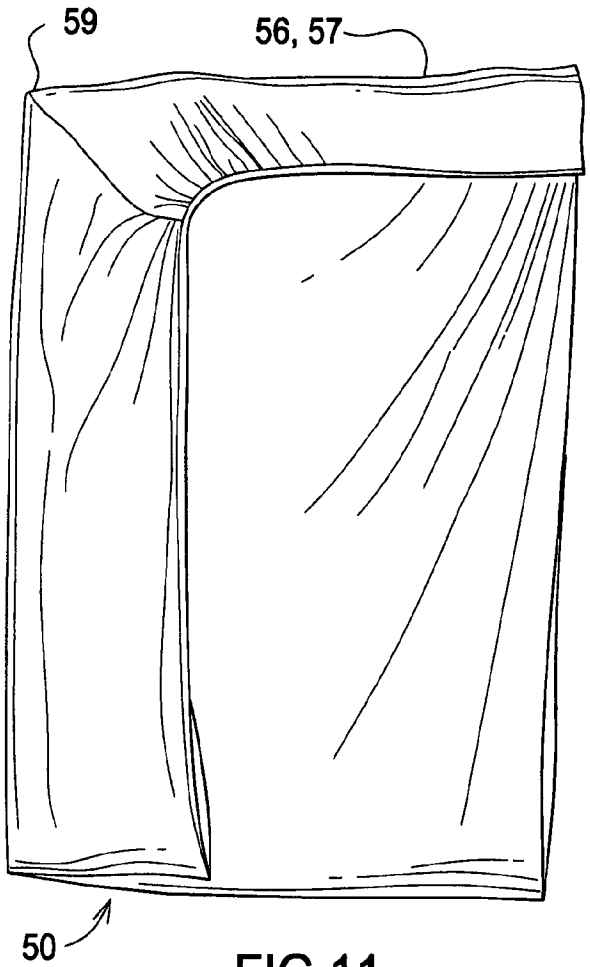
FIG. 11 is a pictorial diagram of the fitted bedsheet following removal from the bedsheet folding aid, illustrating the fitted bedsheet in a partially-folded configuration in which its size is ¼ its original unfolded size.

Operation of fitted bedsheet folding aid 100 may be understood with specific reference to FIGS. 8-10. Hangers 32, 34 of the fitted bedsheet folding aid 100 are first attached over the top of door 60. The length of the left and right rod assemblies 18, 20 is then adjusted to match the size of a particular fitted bedsheet 50 to be folded, as described above and illustrated in FIGS. 4-7. With fitted bedsheet folding aid 100 in its open position illustrated in FIG. 1, corner pockets 52, 54 at each end of one of the two shorter sides of a fitted bedsheet 50 are hooked over respective ones of the spring-loaded rod tips 28 that serve to maintain the top edge 56 of fitted bedsheet 50 in a generally taut position along the span of fitted bedsheet folding aid 100. The top edge 56 of fitted bedsheet 50 is then attached to clip 36. Bedsheet 50 may be oriented either inside out or vice versa when it is initially attached to fitted bedsheet folding aid 100. As indicated by the arcuate dotted lines of FIG. 8 and as illustrated in detail in FIG. 9, the lower left corner pocket 58 of fitted bedsheet 50 is lifted and hooked over the upper left corner pocket 52, and the lower right corner pocket 59 of fitted bedsheet 50 is then lifted and hooked over the upper right corner pocket 54. Like edge 56 of fitted bedsheet 50 that was previously attached to clip 36, edge 57 is next also attached to clip 36. The hinged right rod assembly 20 of fitted bedsheet folding aid 100 is then rotated clockwise, away from door 60, as indicated by the upper arcuate dotted line of FIG. 9, such that fitted bedsheet folding aid 100 is in its closed or folded position illustrated in FIG. 10. In this position, the user may simply release the edges 56, 57 of fitted bedsheet 50 from clip 36 and slide the fitted bedsheet 50 to the left to thereby remove it from the fitted bedsheet folding aid 100. When so removed, bedsheet 50 is in the partially-folded configuration illustrated in FIG. 11 in which its size is ¼ its original unfolded size. In this configuration, the user may place fitted bedsheet 50 on a table top or other horizontal surface and fold it one or more times in either or both its lengthwise or widthwise directions to a desired final folded size. Alternatively, with bedsheet folding aid 100 in its closed or folded position illustrated in FIG. 10, and before removing bedsheet 50 therefrom, the user may first turn the right corner pockets 54, 59 outward to unhook them from rod tip 28 of the rod assembly 20 and hook them over the left corner pockets 52, 58 that were previously hooked over rod tip 28 of rod assembly 18, such that the four corner pockets 52, 58, 54, 59 are hooked over each other, in that order. When then removed from bedsheet folding aid 100, bedsheet 50 may be finally folded as described above.

We claim:

1. A device for aiding in folding a fitted bedsheet, comprising:

a telescoping left rod assembly adjustable in length according to the size of a bedsheet to be folded, said left rod assembly including attachment means for supporting said device in a horizontal position against a vertical surface;

a telescoping right rod assembly adjustable in length according to the size of said bedsheet to be folded, said right rod assembly being hingedly attached to said left rod assembly in abutting relationship thereto to permit a user to rotate said right rod assembly clockwise 180 degrees away from said vertical surface from an open position in which it is longitudinally aligned with said left rod assembly to a closed position in front of said left rod assembly; and a spring clip mounted to said left rod assembly proximate a point of hinged attachment of said left rod assembly to said right rod assembly, said spring clip providing removable attachment by the user of a bedsheet edge spanning said left and right rod assemblies;

each of said left and right rod assemblies comprising an outwardly-urged, spring-loaded tip member at outward ends thereof for receiving corner pockets of said bedsheet to be folded and for maintaining taut the edges of a bedsheet spanning said left and right rod assemblies when said right rod assembly is in said open position.

2. A device as in claim 1, wherein:

said vertical surface comprises a surface of a door; and said attachment means comprises one or more door hanger members connected to said left rod assembly, said door hanger members being adapted to fit over a top edge of said door.

3. A device as in claim 1, further comprising:

left and right support members attached to a front surface of each of said left and right rod assemblies, respectively; and a hinge coupling inward ends of said left and right support members.

4. A device for aiding in folding a fitted bedsheet, comprising:

a telescoping right rod assembly adjustable in length according to the size of a bedsheet to be folded, said right rod assembly including attachment means for supporting said device in a horizontal position against a vertical surface;

a telescoping left rod assembly adjustable in length according to the size of said bedsheet to be folded, said left rod assembly being hingedly attached to said right rod assembly in abutting relationship thereto to permit a user to rotate said left rod assembly counterclockwise 180 degrees away from said vertical surface from an open position in which it is longitudinally aligned with said right rod assembly to a closed position in front of said right rod assembly; and a spring clip mounted to said right rod assembly proximate a point of hinged attachment of said right rod assembly to said left rod assembly, said spring clip providing removable attachment by the user of a bedsheet edge spanning said left and right rod assemblies;

each of said left and right rod assemblies comprising an outwardly-urged, spring-loaded tip member at outward ends thereof for receiving corner pockets of said bedsheet to be folded and for maintaining taut the edges of a bedsheet spanning said left and right rod assemblies when said left rod assembly is in said open position.

5. A device as in claim 4, wherein:

said vertical surface comprises a surface of a door; and said attachment means comprises one or more door hanger members connected to said right rod assembly, said door hanger members being adapted to fit over a top edge of said door.

6. A device as in claim 4, further comprising:

left and right support members attached to a front surface of each of said left and right rod assemblies, respectively; and a hinge coupling inward ends of said left and right support members.

* * * * *